United States Patent [19]

Houghtaling

[11] Patent Number: 5,033,032

[45] Date of Patent: Jul. 16, 1991

[54] AIR-GAP HYDROPHONE

[75] Inventor: Steven Houghtaling, Breckenridge, Colo.

[73] Assignee: Microsonics, Inc., Denver, Colo.

[21] Appl. No.: 408,046

[22] Filed: Sep. 14, 1989

Related U.S. Application Data

[63] Continuation-in-part of Ser. No. 253,191, Oct. 5, 1988, abandoned.

[51] Int. Cl.[5] ..... H04R 17/00

[52] U.S. Cl. ..... 367/160; 367/165; 367/166; 367/152

[58] Field of Search ..... 181/122, 402; 367/141, 367/152, 155, 157, 158, 159, 160, 162, 163, 165, 166, 171, 174, 177, 178, 180, 188

[56] References Cited

U.S. PATENT DOCUMENTS

| | | | |
|---|---|---|---|
| 3,150,346 | 9/1964 | Polly | 367/141 |
| 3,239,801 | 3/1966 | McGaughey | 367/150 |
| 3,331,970 | 7/1967 | Dundon et al. | 310/324 |
| 3,961,305 | 6/1976 | Green | 367/171 |
| 4,010,441 | 3/1977 | Richard | 367/160 |
| 4,134,097 | 1/1979 | Cowles | 367/13 |
| 4,706,226 | 11/1987 | Houghtaling | 367/66 |

OTHER PUBLICATIONS

Applications for the Si1000 Series JFET Amplifier, pp. 7-25 to 7-30, FET Date Book, Published by Siliconix Incorporated, Jan. 1986.

*Primary Examiner*—Brian S. Steinberger
*Attorney, Agent, or Firm*—James R. Young

[57] ABSTRACT

A hydrophone for the detection of sound or vibrational waves, comprising a piezo electric transducer within a Faraday cage such that it is in contact with and yet isolated from a deformable pressure transmitting medium that carries vibrations. The Faraday cage reduces noise interference. The deformable medium is usually a fluid and preferably a vegetable oil, but can also include a silastic compound couple. One side of the Faraday cage is a ground plane of a surface-mount printed circuit board. Components of an electronic circuit for conditioning the signal are mounted on the printed circuit board and include a buffer having an ultra-high impedance input and a very low impedance output. The circuit has a low power draw and is powered by a replaceable battery.

27 Claims, 5 Drawing Sheets

AIR-GAP HYDROPHONE

CROSS REFERENCE TO RELATED APPLICATION

This patent application is a continuation-in-part of patent application Ser. No. 07/253,191, now abandoned but originally filed Oct. 5, 1988, and also entitled Air-Gap Hydrophone.

BACKGROUND OF THE INVENTION

1. Field of the Invention

The present invention is generally related to hydrophone devices for detecting sound or vibrational waves in a fluid medium and more specifically to a hydrophone device that includes improvements in casing design, improved transducer or vibration sensor design, and improved electronic signal processing, all of which contribute to substantially improved, stronger, and more usable output signals indicative of the actual vibrational waves detected with less detrimental noise and other signal degradation factors.

2. Description of the Prior Art

Hydrophones are essentially transducer devices that detect and convert sound or vibrational waves, i.e., series of compressions and rarefactions, in a fluid medium to readable electrical signals that are indicative of the sound or vibrational waves in the medium. Hydrophones can be used for a variety of purposes, including, for example, seismic exploration operations, sonar receivers, and the like.

In seismic exploration operations, such as for locating or analyzing geological features in the earth's crust, some means, such as an explosion, can be used to generate vibration waves in the earth, and the vibration waves reflected by the various geostructures can be detected by hydrophones placed at or near the earth's surface. In land-based seismic exploration operations, the hydrophones can be actually placed in holes bored into the earth and containing water or drilling fluid, which actually transmits the reflected vibration waves from the earth to the hydrophone transducer. In ocean-based seismic exploration operations, the hydrophone transducer can simply be placed in the sea water, which transmits the reflected vibration waves from the earth to the hydrophone transducer.

In active sonar applications, sound waves can be generated in the sea water by any sound-making device, and the sea water then transmits the sound waves to nearby objects and transmits sound waves reflected by the objects directly back to a hydrophone transducer placed in the sea water. Passive sonar operates in a similar manner with a hydrophone placed in the sea water, except the sea water merely transmits sound waves generated by nearby objects to the hydrophone transducer, so that the hydrophone acts as a passive listening device.

Signal quality or, more precisely, the lack of good signal quality generated by the hydrophone, is a common, pervasive problem in both seismic and sonar applications, as well as in many other hydrophone applications. There are many causes of such typical low quality signal generations by hydrophones. For example, in seismic operations, the earth has a well-known inherent filtering effect, which tends to attenuate signals, particularly in higher frequency ranges. Also, the signals are typically very weak and do not always have sharp definition characteristics, yet they usually have to be transmitted by wire many hundreds of feet to data collection points. Extraneous electromagnetic interference and other noises become a real problem with low amplitude signals being transmitted over such long transmission wires. Also, background noises and vibrations in both sonar and seismic operations can interfere and drown out the significant signals. As a result, signal-to-noise ratio at the data collection point is usually very low.

Further, typical hydrophone transducers utilize piezoelectric devices to convert physical vibrations to electrical signals. Such piezoelectric hydrophones are notoriously sensitive to extraneous electromagnetic interference, which is becoming more of a problem as geophysical acquisition in the industry is moving toward desiring more sensitive and higher resolution recordings of geophysical data.

Also, the ceramic piezoelectric crystals typically used in hydrophones can be over-flexed and damaged, such as possibly caused by exposure to a high pressure or by jarring or mishandling the hydrophone. This problem has been controlled in contemporary hydrophones by mounting the ceramic piezoelectric crystal on a thicker metal carrier plate. Unfortunately, however, the thicker the carrier plate is made for more protection of the ceramic crystal, the less sensitive the ceramic crystal becomes to sound or vibration waves. Thus, thicker support or carrier plates in the conventional mounting practice, while providing more physical protection for the ceramic crystal, thus pressure resistance of the hydrophone, also sacrifices sensitivity and resolution of geophysical signal data.

Amplifiers at the hydrophone location unfortunately do not solve these problems, since they amplify all components of the signal generated by the same degree, including environmental and circuit noise levels. A substantial improvement was made by my non-linear seismic line amplifier described in U.S. Pat. No. 4,706,226, which conditions the signal to counteract natural attenuation by the earth, provides an output signal having a substantially flat frequency response for a seismic impulse, and increases the signal-to-noise ratio. However, there are non-linear hydrophones available, and a vastly more significant advance would be represented by a hydrophone that produces a superior signal with better resolution and greater signal-to-noise ratio before amplification and conditioning.

Other problems have also persisted in the manufacture and use of hydrophones, particularly in geophysical explorations. For example, seismic crews usually try to monitor the sensor connection to their recording equipment with a simple ohm meter arrangement. High output impedances of some prior art hydrophones require shunt resistors across the output leads with resistances beyond the ranges of the line monitoring devices of the recording equipment, such as in the range of 100K. Thus, much lower output impedance of the hydrophone is desired, preferably such that a shunt resistor in the range of only about 10K can be used in monitoring the connection to the recording equipment.

Also, it is common in the seismic exploration industry for hydrophones to be disposable, i.e., used only once. Many contemporary fluid-coupled and pressure sensors utilize fluids such as naphtha, trichloroethylene, or automotive transmission fluid as the transmitting medium of a fluid couple, all of which not only have to be degassed to remove air bubbles to maintain sensitivity, but are also potentially damaging to environmentally sensitive areas, particularly when they get blown apart by the vibration-inducing explosions commonly used. Therefore, another substantial improvement would be to have a low power, battery operated hydrophone that can be reused indefinitely and fluid-coupling devices that are not only more sensitive, but which also do not have to be degassed and are environmentally safe.

SUMMARY OF THE INVENTION

Accordingly, it is a general object of the present invention to provide a hydrophone that produces cleaner, higher resolution signals or data.

It is another object of this invention to provide a hydrophone that is more sensitive, yet which also provides a greater signal-to-noise ratio, than previously available hydrophones.

A more specific object of this invention is to provide a hydrophone in which the mechanical transducer design provides much clearer, higher resolution signals that are substantially free from environmental noises and interferences, both physical and electronic.

A still more specific object of this invention is to provide a hydrophone with a sufficiently sensitive mechanical design for the transducer and electronic package to produce a signal that is strong enough, clear enough, and with sufficient resolution that further additional electronic amplification within the hydrophone itself is not normally necessary in common geophysical exploration operations when used with conventional site recording equipment.

Another specific object of this invention is to provide a hydrophone with a piezoelectric sensor for generating electronic signals in response to vibration induced flexure with a vibration carrying fluid medium on one side and a sealed and isolated air gap chamber on the other side to induce a pressure differential across the piezoelectric sensor, thus prestressing the sensor when the hydrophone is immersed in fluid, and wherein the electronic circuit is mounted on a carrier substrate that forms a wall of the air gap chamber.

Yet another specific object of the present invention is to provide a mechanical sensor construction that acts as a low impedance Farraday cage around the high impedance piezoelectric sensor crystal in the air gap chamber to shield the high impedance piezoelectric sensor and signals produced by this sensor from extraneous electromagnetic interference.

A further specific object of the present invention is to provide a unique impedance matching source follower buffer electronic circuit, rather than an amplifier, for an interface between the piezoelectric device in the hydrophone and the conventional geophysical sight recording equipment, and for avoiding circuit-generated noises that can dilute signal quality and resolution.

A still further specific object of this invention is to provide a non-linear version of the hydrophone with a uniquely designed high pass, low cut filter that, in combination with the unique source follower circuit, is uniquely suited for excellent filter response in this extraordinarily sensitive, high resolution, low noise signal while operating with relatively low power consumption.

Another specific object of this invention is to provide a miniaturized electronic filter circuit for the non-linear hydrophone that can be placed directly on the hydrophone carrier for optimizing high resolution signal recording capabilities.

Still another object of the present invention is to provide a hydrophone in which the user can choose various frequencies to match a specific environment.

Yet another object of the invention is to provide a reusable hydrophone that has a low power consumption and a replaceable, self-contained power supply and in which all components are replaceable, including the sensor and the electronic circuit board.

A further object of this invention is to provide a fluid-coupled hydrophone that is generally environmentally compatible and which does not require degassing.

A still further object of this invention, is to provide a generally rugged hydrophone that is configured for dependable use and reuse in most common geophysical exploration operations, boreholes, and sonar applications.

To achieve the foregoing and other objects and in accordance with the purposes of the present invention, as embodied and broadly described herein, the apparatus of this invention may comprise a carrier plate on which is mounted a transducer, such as a piezo electric element, for converting vibrations to electric signals, with one side of the carrier plate positioned in contact with a deformable medium, usually a fluid, that carries vibrations and with a chamber on the other side that is isolated from the fluid. The chamber is surrounded by condine, low impedance components that form a Farraday cage around the transducer and high impedance lead from the transducer. One side of the Farraday cage is a ground plane of a surface-mount printed circuit board. Components of an electronic circuit for conditioning the signal are mounted on the printed circuit board and include a buffer having an ultra-high impedance input and a very low impedance output. A constant current source in the buffer keeps external spikes and interference on the output from becoming internally-propagated noise in the buffer circuit. A high pass, low cut, second order active filter utilizing a PNP bipolar transistor to feedback into the second order element can also be provided to filter out extraneous noises and unwanted signals. The circuit has a very low noise and low power draw and is powered by a replaceable battery. The receptor preferably can include an elongated boot enclosing a compartment, filled with deformable, pressure transmitting medium, preferably a vegetable oil fluid coupling medium, in contact with the carrier plate, but can also include a silastic compound couple.

Additional objects, advantages, and novel features of this invention are set forth in part in the description that follows, and in part will become apparent to those skilled in the art upon examination of the following specification or may be learned by the practice of the invention. The objects and advantages of the invention may be realized and attained by means of the instrumentalities and in combinations particularly pointed out in the appended claims.

BRIEF DESCRIPTION OF THE DRAWINGS

The accompanying drawings, which are incorporated in and form a part of the specifications illustrate the preferred embodiments of the present invention, and together with the description serve to explain the principles of the invention.

IN THE DRAWINGS

Figure 1:
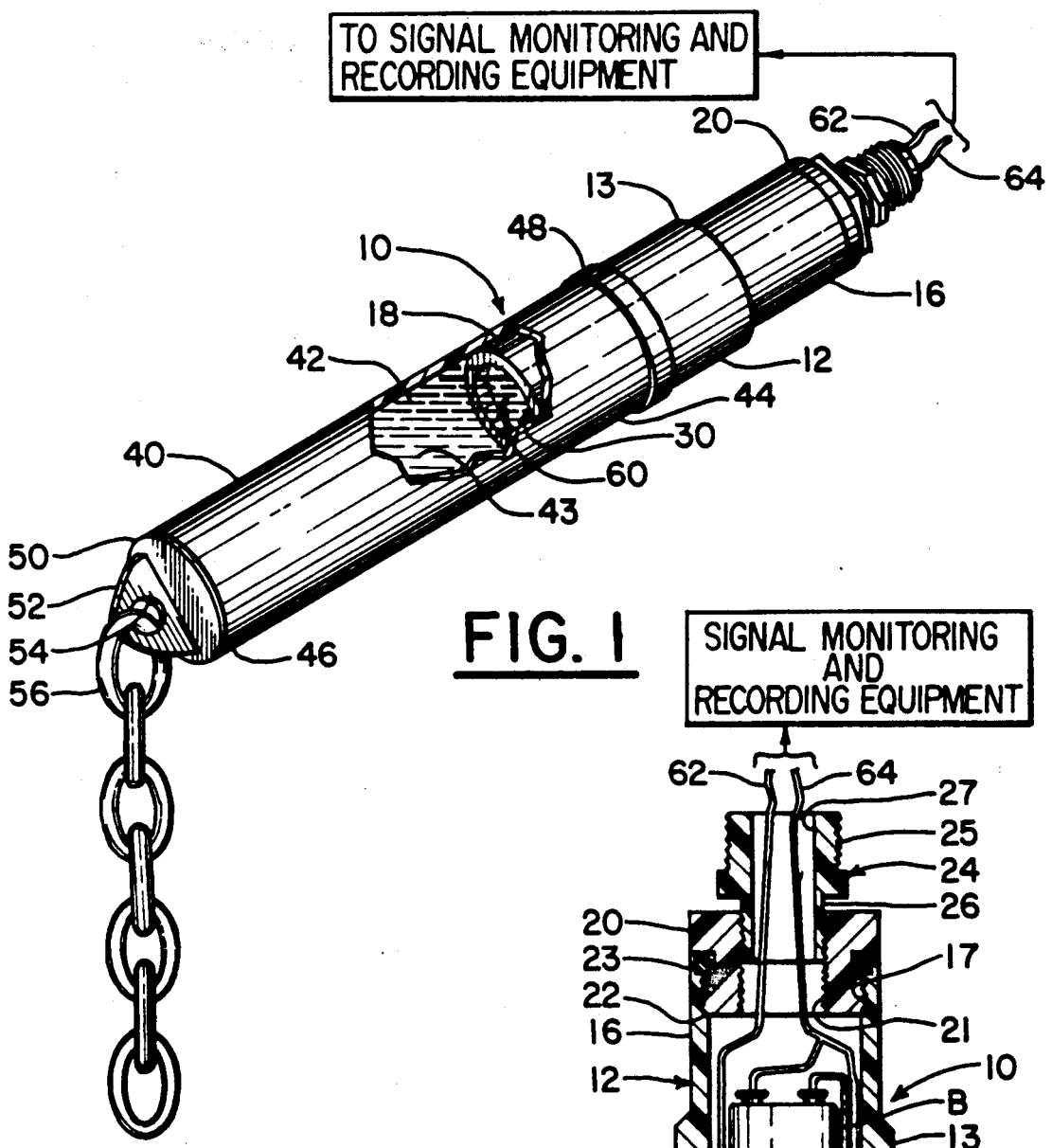
Figure 5:
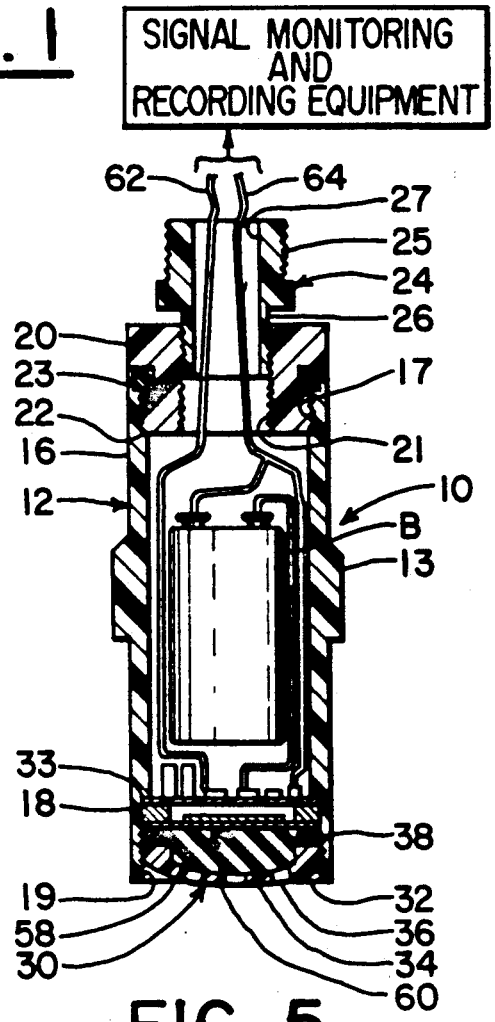
Figure 2:
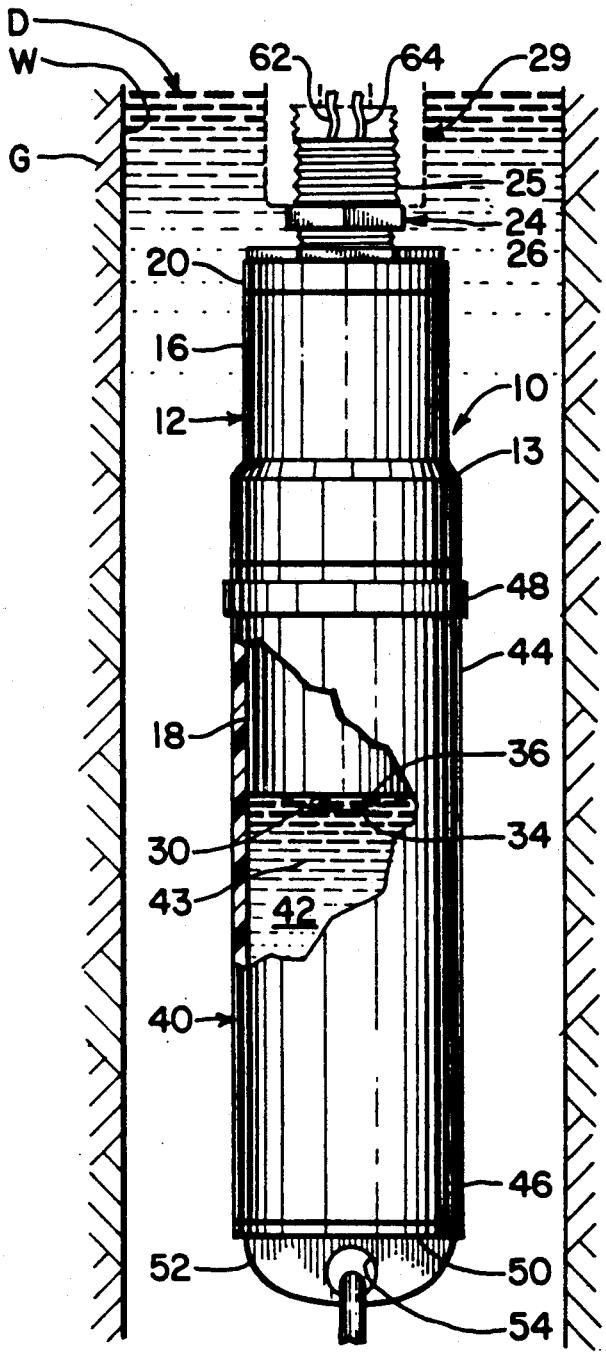
Figure 3:
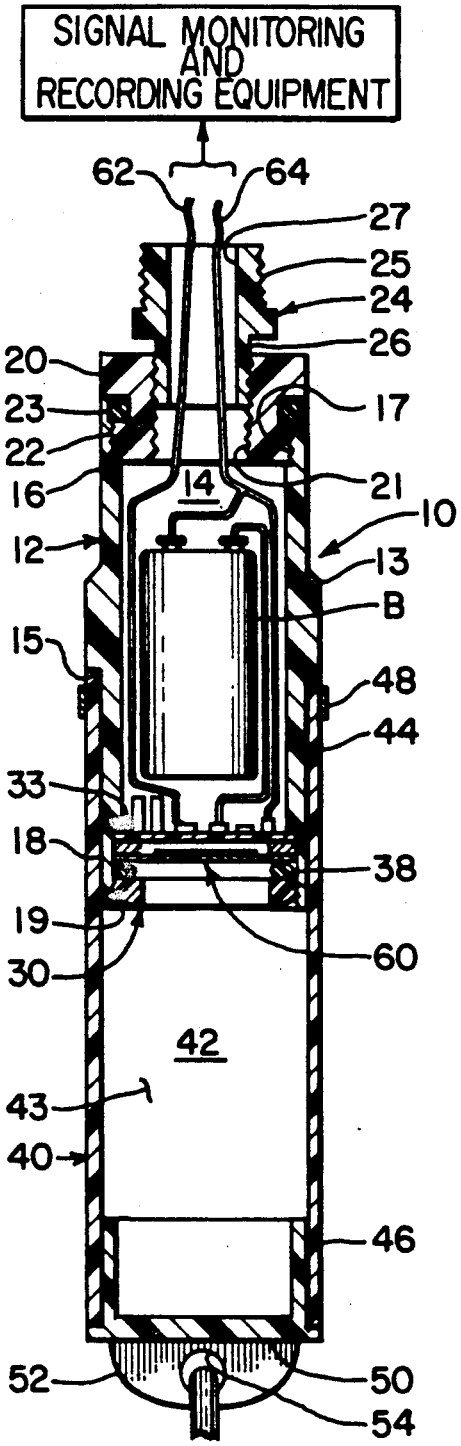
Figure 4:
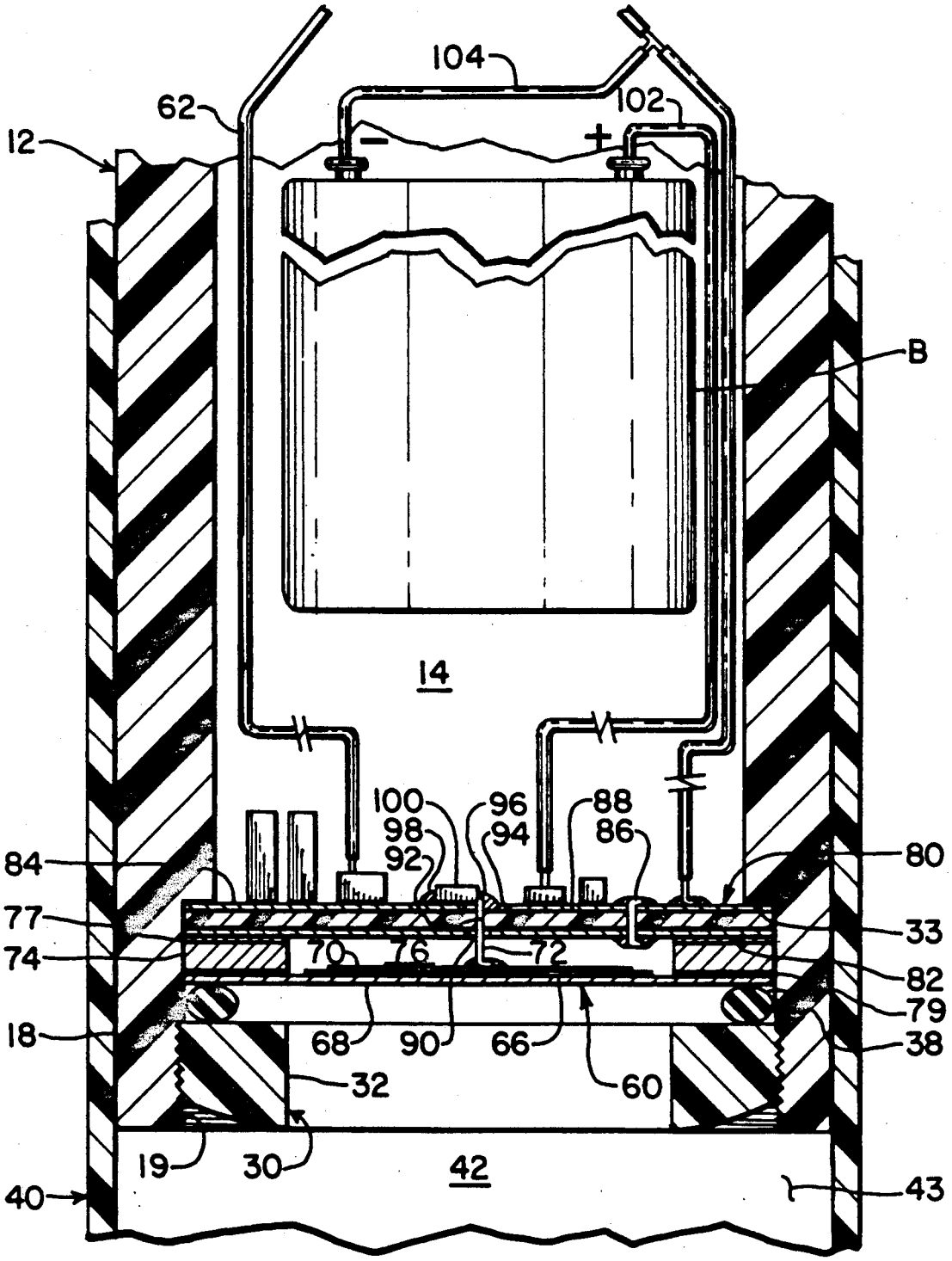
Figure 6:
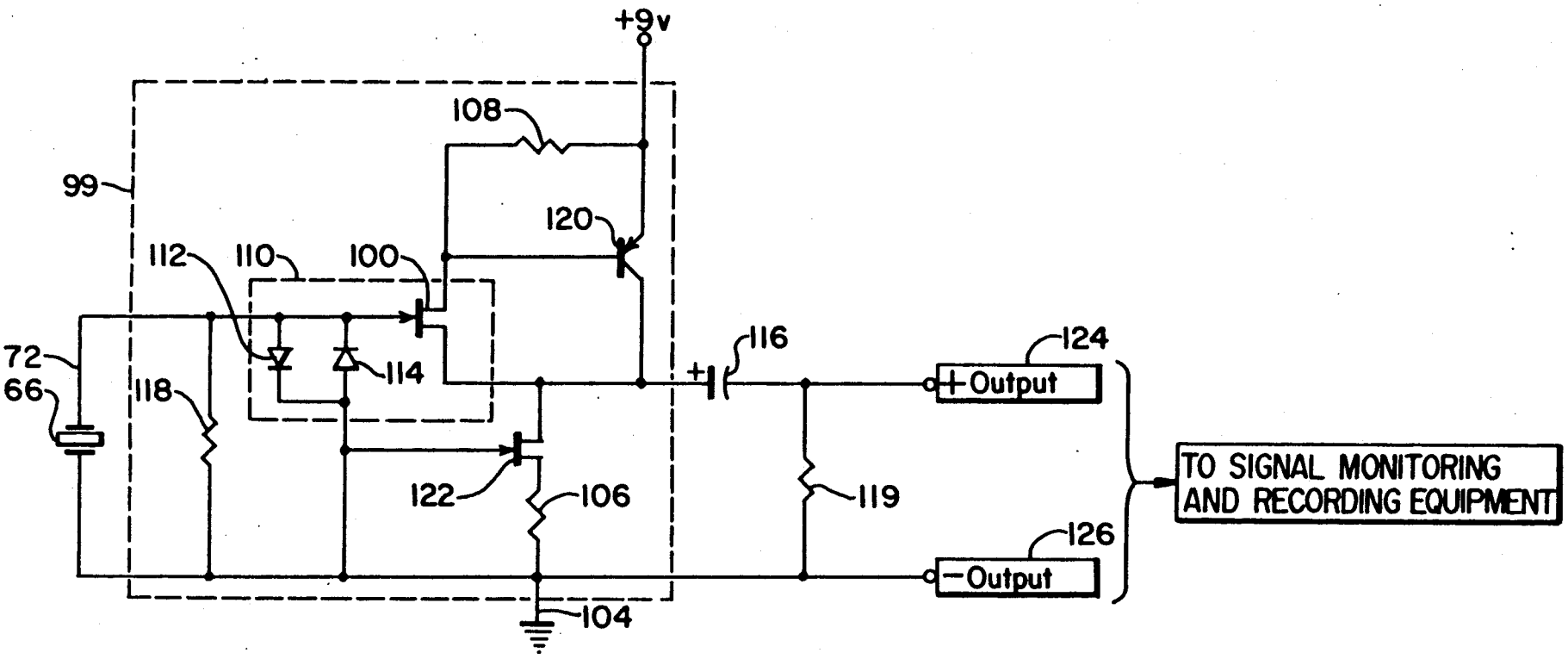
Figure 7:
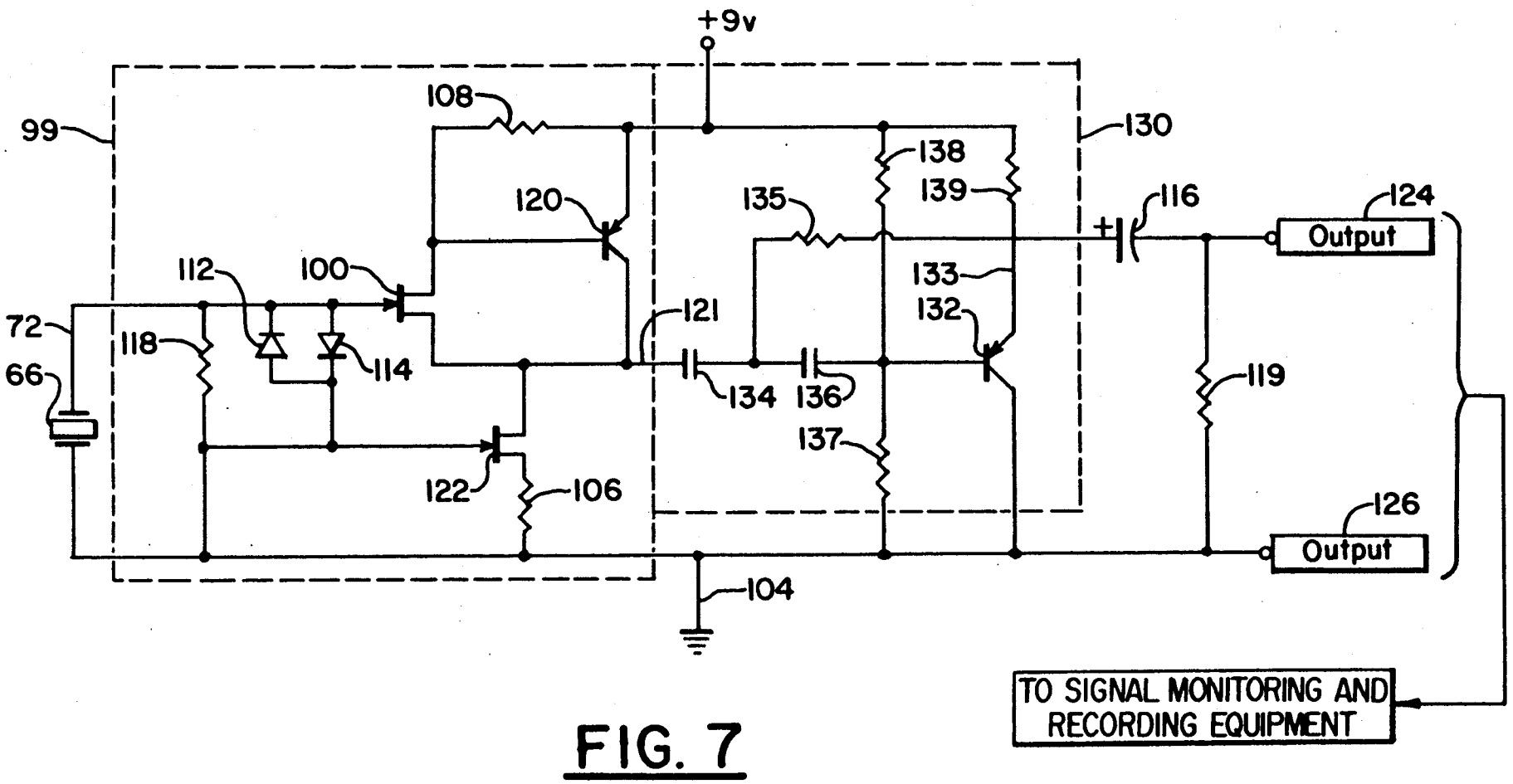

FIG. 1 is an isometric view of the hydrophone apparatus of the present invention with a portion of the flexible boot cut away to show the fluid medium couple to the transducer therein;

FIG. 2 is a side elevation view of the hydrophone apparatus of this invention shown positioned in a fluid-filled bore hole in the earth's surface, as is a common use environmental hydrophones used in land-based seismic exploration operations, a portion of the boot shown cut away to reveal the fluid coupling of this invention;

FIG. 3 is a side elevation similar to FIG. 2, but in cross-section to illustrate the internal structure and arrangement of components in the hydrophone of the present invention;

FIG. 4 is an enlarged cross-sectional view of the transducer and electronic components structure and arrangement according to this invention;

FIG. 5 is a modified embodiment of the hydrophone of the present invention for use in direct coupled applications;

FIG. 6 is a circuit diagram of a first embodiment linear electronic signal circuit according to this invention; and FIG. 7 is a circuit diagram of a second embodiment non-linear electronic signal circuit according to this invention.

DETAILED DESCRIPTION OF THE PREFERRED EMBODIMENTS

The hydrophone 10 according to the present invention is shown generally FIGS. 1, 2, and 3. It is comprised essentially of a cylindrical barrel 12 that substantially encloses a compartment 14 and a transducer assembly 60 for converting vibrations or sound waves into electrical signals. It can also include a boot 40 that contains a deformable, pressure transmitting medium or fluid 43 in a compartment 42 for transmitting vibrations or sound waves to the transducer assembly 60. These and other components of the hydrophone 10 will be described in more detail below.

A plug 20 in the top end 16 of barrel 12 encloses the top of compartment 14 and provides an attachment structure for a nipple 24 or other suitable fitting, such as for connection to a conventional wireline tool 29 (represented by phantom lines in FIG. 2) or to any other appropriate mounting or attaching structure. Wire leads 62, 64 carry electrical signals produced by the transducer assembly 60 to conventional seismic monitoring equipment (not shown), sonar equipment (not shown), or other components (not shown) designed to utilize such electrical signals.

In a typical land-based geophysical exploration application, the hydrophone 10 can be suspended on a wireline tool 29, as illustrated in FIG. 2, in a well W bored into the ground G. The well bore W usually contains water or a drilling fluid D. Sound waves or vibrations induced by some source, such as an explosive (not shown) or by natural phenomena, such as an earthquake, are transmitted by the earth's crust, either directly or after reflecting from various geophysical strata, to the well bore W. The water or drilling fluid D in the well bore W transmits the vibrations to the hydrophone 10.

In the embodiment shown in FIGS. 1, 2, and 3, the cylindrical walls of boot 40 are flexible and contain a deformable, pressure transmitting medium or fluid 43 enclosed in compartment 42. The vibrations in the water or drilling fluid D in well bore W flex the walls of boot 40 and are transmitted by the fluid medium 43 to the transducer assembly 60, where electronic signals are produced that are indicative of the vibration characteristics.

The top end 16 of barrel 12 preferably has internal threads 17 into which the externally threaded neck of the plug 20 can be screwed with an O-ring seal 23 interposed therebetween. Plug 20 is shown with an internally threaded bore 21 for receiving the externally threaded neck 26 of nipple 24, and the nipple 24 has a threaded section 25 adapted for attachment to a conventional wireline coupling tool 29 or other mounting as desired. The bore 21 in plug 20 and the bore 27 in nipple 24 also allow passage of signal-carrying wires 62, 64 to the wireline (not shown) and to monitoring equipment (not shown) on the surface of the ground.

The bottom of the compartment 14 in barrel !2 contains the transducer assembly 60, which will be described in more detail below. However, for purposes of describing the macrostructure of the hydrophone 10, suffice it to say at this point that the transducer assembly 60 according to this invention is preferably in the form of a cylindrical, wafer-like structure sandwiched between an internal shoulder 33 and a retainer 30 in the lower end 18 of barrel 12, as shown in FIG. 3 and in enlarged detail in FIG. 4. The retainer 30 preferably comprises an externally threaded annular rim 32 screwed into the internally threaded end bore 19 of barrel 12. The deformable, pressure transmitting medium or fluid 43 in compartment 42 can have direct contact with the transducer assembly 60. An O-ring seal 38 is provided between rim 32 and transducer assembly 60 to keep the coupling medium 43 from leaking around transducer assembly 60 and into compartment 14.

The compartment 14 above the transducer assembly 60 contains the electronic circuitry components of the transducer assembly, as will be described more fully below, and a battery B. The battery B can be replaced by removing plug 20, and the transducer assembly 60 can be replaced by removing the boot 40 and the retainer 30.

The upper end 44 of boot 40 slips over a cylindrical lower portion 18 of barrel 12 until it abuts shoulder 15 and can be secured in place by a ring clamp 48. The shoulder 15 is formed by a flared collar 13, which maintains a streamlined external surface that is not so vulnerable to snagging in the well W. The lower end 46 of boot 40 is closed by a plug 50. The plug 50 can have an attachment structure, such as the ear 52 with a hole 54 therein, for attaching a length of chain 56 or other object to the bottom of the hydrophone 10. The chain 56 can function as a flexible weight for guiding and sinking the hydrophone 10 more efficiently and rapidly through the drilling fluid D and down uneven well bores W.

The boot 50 can be formed with a flexible vinyl tube or other suitable material. The deformable, pressure transmitting coupling medium 43 according to this invention is preferably an organic oil, although it can be one of many other non-compressible fluids, such as the conventional naptha, trichloroethylene, or automotive transmission fluids that are commonly used as transmitting mediums in fluid coupled hydrophones and pressure sensors. A non-compressible fluid, of course is an effective coupling medium because a non-compressible fluid effectively transmits a pressure applied on any portion of its surface equally to all other portions of its surface. Thus, where the transducer assembly 60 forms a portion of the confining surface, a pressure, such as a sound wave or compression, applied to one portion of the fluid medium 43 surface is effectively transmitted to the transducer assembly 60. There are several advantages to the use of organic oils as the deformable, pressure transmitting coupling medium 43 in the application of this invention. For example, there cannot be any gas in the fluid medium 43 that could form compressible bubbles and interfere with the transmission of vibrations to the transducer assembly 60. The above-mentioned naptha, trichloroethylene, and automotive transmission fluids commonly used as fluid coupling mediums typically have entrained gases in them and have to be put through a rigorous degassing process before they can be used effectively. Vegetable or peanut oils do not contain entrained gasses and do not have to be put through such degassing processes for use with this invention. Also, hydrophones are frequently damaged during use, and organic oils that might leak due to such damage are not detrimental to environmentally sensitive areas.

The hydrophone 10 according to the present invention can also be modified, as shown in FIG. 5, for use as a direct coupled hydrophone instead of a fluid coupled hydrophone. Essentially, the boot 40 and coupling fluid 43 from FIG. 2 are removed in the FIG. 5 embodiment, and the retainer 30 has an end cap 34 with holes 36 therethrough that extends inwardly from the lower end of rim 32. The space between the transducer assembly 60 and the end cap 34 of retainer 30 is filled with another deformable, pressure transmitting medium in the form of a silastic compound 58. Such a silastic compound 58 is a deformable material that is not a fluid in the sense that its molecules cannot flow freely past each other, but it does have the property of transmitting a pressure applied to one portion of its surface to other confined portions of its surface in a manner similar to a noncompressible fluid. This FIG. 5 embodiment is appropriate for use in underwater ocean geophysical operations, sonar receivers, and the like, where the vibrations to be detected are transmitted by the sea water to the hydrophone 10. The silastic compound 58 is deformable and acts like a non-compressible fluid medium, as described above, in transmitting vibrations from the sea water (not shown) to the transducer assembly 60, but it maintains its basic form and position in the retainer 30.

A significant feature of the hydrophone 10 according to this invention is the mechanical structure and electronic circuitry of the transducer assembly 60 integrally assembled in a compact package that reduces noise interference and eliminates the need for additional electronic amplification, and thereby provides cleaner, higher resolution data while utilizing significantly less energy and reducing construction costs. More specifically, the transducer assembly 60, as best seen in FIG. 4, includes a piezoelectric monomorph 66 mounted on a carrier plate 68 and effectively surrounded by a low-impedance, Farraday cage type of enclosure for shielding the piezo monomorph 66 from extraneous electromagnetic interference and with fluid pressure on one side of the piezo monomorph 66 and a sealed air gap on the other side. The term "low impedance" for the purposes of the Farraday cage and for descriptive purposes of this invention generally refers to an electrically conductive material, such as a material having an impedance that is typically in the range of about one ohm (1Ω) or less.

The carrier plate 68 is preferably conductive metallic plate, such as brass, beryllium-copper alloy, or the like with the piezo monomorph crystal 66 bonded thereto with any suitable bonding material, such as a conductive glassy epoxy. The piezo monomorph 66 is preferably a type that generates an electric voltage or signal in proportion to magnitude of flexture of the monomorph, such as the piezo-ceramic monomorphs manufactured by Edo Western Corp. in Salt Lake City, Utah. A thin, conductive film contact 70, such as aluminum, is deposited on the interior side of the piezo monomorph 66 by sputtering, vapor deposition, or other suitable process. A fine wire or "whisker" lead is attached to the contact 70 and serves as one lead of the signal circuit from the piezo monomorph 66 to the electronic circuit, which will be described in more detail below. The conductive carrier plate 68 serves as the other lead of the signal circuit from the piezo monomorph 66.

A rigid, annular, spacer ring 74, preferably made of a conductive metal, such as brass or bronze, is sandwiched between the carrier plate 68 and a two-sided, surface mount, printed circuit board 80. The spacer ring 74 is thicker than the piezo monomorph 66 and preferably bonded and sealed on one surface to the carrier plate 68 and on the other surface to the printed circuit board 80 by a conductive material, such as metal filled epoxy as indicated at 79 and 77, respectively. This type of mounting has several advantages in addition to allowing the spacer ring 74 to serve as a continuation of the other lead of the signal circuit from the piezo monomorph 66 through the carrier plate 68. First, it provides a sealed air gap or chamber 76 on one side of the piezo monomorph 66 that can be kept at atmospheric or any other desired pressure, but isolated from the fluid pressure that is applied on the opposite side by the coupling fluid medium 43 (not specifically shown in FIG. 4), which is in contact with the external or bottom surface of the carrier plate 68.

Second, by bonding the relatively thin carrier plate 68 to the relatively thicker spacer ring 74, additional sensitivity can be obtained without sacrificing pressure resistance, i.e., the ability to withstand high pressure without over-flexing the piezo monomorph 66. In a conventional circumferential mounting of a carrier plate on an annular support, the carrier plate is free to move in relation to the support. In such mounting arrangements, pressure resistance has been controlled by thickening or thinning the carrier plate to achieve a balance between sensitivity and pressure resistance. A thicker carrier plate obviously results in less ability of a vibration or applied pressure to flex the carrier plate and the piezo monomorph, thus less sensitivity to the vibrations being detected.

According to the present invention, however, a thinner carrier plate 68 is bonded, as described above, to a substantially thicker annular spacer ring 74. As the carrier plate 68 is forced or flexed with increased hydrostatic pressure, it goes into tension so that the tensile strength of the carrier plate 68 provides additional resistance to the increased pressure. This structure is analogous to a thin drum membrane that could not support nearly as much weight or pressure if its edges were not attached to the rim of the drum. Therefore, it allows the hydrophone 10 to operate in much higher hydrostatic pressures with stock thin plate piezo monomorphs 66 and carrier plates 68 while still maintaining high sensitivity to vibrations in the fluid medium.

The printed circuit board 80, as shown in FIG. 4, encloses the top side of the air gap or chamber 76. It is preferably a surface mount type printed circuit board comprising a nonconductive substrate 88 sandwiched between two conductive ground planes or plates 82, 84.

The nonconductive substrate 88 can be made of any suitable plastic, nonconductive resin, or other suitable material, and the ground planes 82, 84 can be made of a suitable metal, such as tin-plated etched copper. The bottom or interior ground plane 82 is bonded to, and in electrical contract with, the spacer ring 74, as described above, and it is electrically connected to the top or exterior ground plane 84 by a solder-filled or a threaded-through connector 86 extending through the substrate 88. This structure completes the electrical circuit from the bottom side of the piezo monomorph 66 to the top ground plane 84 of the printed circuit board 80 on which the components of the electrical circuit, such as the FET 100, are mounted.

The high impedance output from the top side of the piezo monomorph 66 is connected directly to the FET 100 by a fine wire or "whisker" connection 72 soldered at one end to the silver contact 70 on the piezo monomorph 66 and at the other end to the FET 100. The whisker connection extends through a small hole 90 in the bottom ground plane 82, through a hole 92 in the substrate 88, and through an opening 94 in the top ground plane 84 where it is connected, such as by solder 96, to the FET 100. Connector 72 is very short, preferably extending no more than several milimeters, and more preferably 1 mm or less, above the top ground plane 84. The casing of the FET 100 is soldered, as indicated at 98 to the top ground plane 84, as are the common or ground segments of various others of the electronic circuit components in typical surface-mount fashion.

As mentioned briefly above, this transducer structure 60 provides a number of advantages. Its sealed, wafer-like structure makes it easily replaceable as a unit in the hydrophone 10. More important, however, it provides a structure where the coupling fluid 43 is in direct contact with the carrier plate 68, yet the high impedance piezo monomorph itself is completely surrounded by the low impedance ground components of the electric circuit, which forms a Farraday cage that effectively shields the sensor or transducer components from extraneous electromagnetic interference. This shielded structure, by virtue of the completeness of its coverage surrounding the higher impedance components and of the close proximity of the low impedance shielding structure to the high impedance piezo monomorph sensor 66, effectively eliminates the extraneous electromagnetic interference that has commonly plagued other piezoelectric hydrophones. For example, the close proximity of the low impedance shielding to the higher impedance piezo monomorph sensor 66 of the preferred embodiment of this invention range is preferably in the range of about ¼-inch or less, thereby creating a small space 76 therebetween that is typically less than ⅛-inch.

The terms "higher impedance" and "high impedance" as used herein generally means components that are higher in impedance than the "low impedance" components as defined above, as should be readily understandable to persons skilled in this art. Specific example impedances of significant components are provided later in this description.

Surface mounting of the active components of the electronics circuit on the outside plane 84 of the two-sided printed circuit board 80 enhances the integrity of the Farraday cage shield, since there are no pin connections extending through the bottom or interior ground plane 82. Even the high impedance lead 72 is virtually surrounded by the low impedance shield, leaving only a millimeter or less exposed at the connection 96 to outside electromotive interference, and even that connection 96 is encircled by the component side ground plane 84 of the circuit board 80. The result is that this shielded, unitary, compact, wafer-like construction, allows the piezo monomorph 66 to be mounted on a thinner carrier plate 68 in direct contact with the coupling medium 43 or 58 for more sensitivity, as described above, while the high impedance components and signal are effectively shielded from external electromotive interference, thus providing the basis for a high resolution, low noise signal right at the start in the transducer assembly 60.

The electronic circuit of the present invention, FIG. 6, is designed to take advantage of the highly sensitive, low noise, initial signal provided by the piezo monomorph 66 in the enclosed, shielded, wafer-like transducer assembly described above and to further condition it and send it to conventional seismic monitoring or other equipment in a manner that does not unduly add noise to, or allow undue degradation of, the signal. Essentially, the piezo monomorph 66, as mentioned above, provides a very high impedance signal input to the electrical circuit. For the best output signal for transmission to the conventional monitoring equipment, it is desirable to have a low power, low noise, and low impedance output.

To achieve the output parameters described above, the electric circuit according to the present invention is preferably a reflected resistance, one-to-one ratio voltage follower buffer, rather than an amplifier, with the circuit elements performing the same impedance transfer as, albeit more effectively than, obsolete transformer coupled hydrophones. Essentially, the buffer circuit 99 of the present invention, illustrated in FIG. 6, is a bipolar assisted, modified source follower, which utilizes a JFET 100 for a first stage having ultra-high input impedance to accommodate the high impedance piezo monomorph 66 and a relatively low impedance output. The JFET 100 is direct coupled to a second stage that utilizes a bipolar PNP transistor 120 for lowering the output impedance even further to a very low level. The reflected resistance through the base of the bipolar PNP transistor 120 is paralleled with the effective output resistance of the JFET 100 to produce an even lower output resistance and a near unity voltage gain. This circuit allows the high impedance piezo monomorph source 66 to be matched with virtually no signal loss to the low impedance outputs, represented in FIG. 6 at 124, 126, from where the signal is transmitted by wires 62, 64 (shown in FIGS. 1–5) to remote monitoring and recording equipment (not shown). The JFET 100 is self-biased by source resistor 106, which avoids biasing resistor noises encountered in some other FET-operated hydrophone circuits currently available.

As shown in FIG. 6, two parallel diodes 112, 114 are connected between the gate of JFET 100 and the substrate or ground 104 to clip transient spikes and overvoltages. This diode clamp protects circuit components and the output from sudden voltage increases, as for example from a sudden, extraordinarily high pressure jolt on, or flexture of, the piezo monomorph 66. A JFET 100 and two parallel diodes 112, 114 connected in this fashion is available as a monolithic part 110 identified by the model or trademark Si 1000 or SST-6909 from Siliconix Incorporated, of Santa Clara, California. A similar circuit is also described on pages 7-25 through 7-28 of the "FET Data Book", published by Siliconix Incorporated, in January 1986.

For purposes of this invention, however, the above-described bipolar assisted source follower circuit is preferably further modified by providing a self-biased JFET 122 with a lower cut-off voltage $V_{gs}$ (off) than JFET 100 and a lower shorted gate drain to source current $I_{dss}$ than JFET 100 positioned between the source of JFET 100 and source resistor 106 and between the collector of transistor 120 and the resistor 106. This modification effectively solves another problem typical of geophysical exploration applications for hydrophones. Specifically, the transmission leads 62, 64 are often layed over large distances to the seismic monitoring and recording equipment (not shown), typically anywhere from hundreds of feet to five miles or more. Such long lead wires 62, 64, or ground lines as they are called in the industry, are very susceptible to large electromagnetically induced spikes and interference from outside sources, acting much like an antenna. Even shielding these leads 62, 64 is insufficient to prevent such interference and voltage fluctuations where such large distances are involved. Such interference and externally induced spikes and fluctuations, in the absence of JFET 122, could show up in the above-described circuit across the source resistor 106, thus varying the biases of both the JFET 100 and the bipolar transistor 120 and resulting in detrimental electronic noise superimposed on the signal output. However, the JFET 122 functions as a constant current source and holds the DC current through resistor 106 constant, thus minimizing or virtually eliminating extraneous noises in the output signal that could otherwise be produced by external electromagnetic effects on the leads 62, 64. This constant current source JFET 122 also provides a steady power supply to the circuit 99, thus eliminating variations due to power loss over the useful life of the battery B.

For purposes of illustration and not for limitation, a circuit as shown in FIG. 6 can be utilized with a 1.33-inch diameter EC-B5 piezo-ceramic monomorph 66 manufactured by Edo Western Corp. of Salt Lake City, Utah, an SST-6909 JFET 100 and an SST-203 JFET 122 (sorted) manufactured by Siliconix Incorporated, of Santa Clara, California, and an MMBT-4250 bipolar transistor 120 manufactured by National Semiconductor of Santa Clara, California. The source resistor 106 can be 2.48k, the emitter bias resistor 108 can be 18.2KΩ, and the bypass capacitor 116 can be 47μF. A 1.0MΩ shunt resistor 118 can be provided for impedance matching, and a 10.0KΩ shunt resistor 119 can be provided to protect the common ohmmeter equipment used by seismic crews to monitor the hydrophone connection to their recording equipment. The low impedance output of this circuit allows the use of such a relatively low resistance shunt 119 instead of the 100kΩ shunts commonly used on other currently available hydrophones, which is way beyond the range of conventional line monitoring devices.

With these illustration values given above, the buffer circuit 99 of the present invention will typically have a first stage ultra-high input impedance to accommodate the piezo monomorph 66. The term "ultra-high" impedance as used for purposes of this description generally means about 1GΩ or more, and preferably in the range of about 500GΩ. This first stage input is shunted by resistor 118 to circuit ground to a valve in the range of 1MΩ. Further, these valves given above create an effective output impedance of JFET 100, as paralled through PNP transistor 120, that is very low. The term "very low" as used herein for purposes of describing the output impedance of JFET 100 is considered to be less than about 1KΩ, and preferably in the range of about 400Ω. The voltage gain of this buffer circuit is very near unity. The term "very near unity" as used herein for describing the voltage gain of this buffer circuit is an output voltage $V_{out}$ within the range of about 95% of input voltage $V_{in}$ and for this circuit is usually measured at about 97%. Unity gain, of course, is $V_{out}$ equal to $V_{in}$, or $V_{out}/V_{in}=1$.

A coupling capacitor between the piezo monomorph 66 and JFET 100 is not needed, because the piezo monomorph 66 acts like a capacitor. A standard 9.0 v battery B can be provided to power the circuit. It is preferred that the resistances be trimmed to provide a power draw of less than 450μA, and, when outfitted as described above, the circuit will draw an average of 200μA at 8.0 v, 400Ω output impedance. Thus, the term "low power" for purpose of this description generally means less than 450μA, and preferably in the range of about 200μA.

While the above-described linear circuit shown in FIG. 6 is practical and functions well in the hydrophone 10 of the present invention, there are many advantages provided by a circuit having a non-linear, i.e., filtered output. While it is beyond the scope of this description to provide an exhaustive listing and explanations of such advantages, an example is that background vibrations and extraneous sounds in the earth or in the transmitting medium can be filtered out at the hydrophone before they are received by the monitoring or recording equipment.

The electrical circuit embodiment shown in FIG. 7 has essentially the same bipolar assisted source following buffer as that shown in FIG. 6 and described above, plus the addition of a precision, low cut filter circuit for controlling the frequency cut-off point as well as dampening with very few parts and low noise. As with the buffer circuit described above, it is very beneficial to avoid op amp components in this application. While op amps theoretically can perform the same overall functions as being accomplished here, op amps currently available unfortunately use excessive power and produce unwanted noise in the circuit.

In the non-linear circuit shown in FIG. 7, a second-order, high-pass, 12 db/octave active filter 130 is added to the buffer circuit 99 described above and shown in FIG. 6. This high pass filter is usually set at a 3 db down point at between 10 to 100 Hz for most oil well related seismic exploration application, but may be set higher or lower depending upon the application. This active filter circuit 130 is similar to a second-order, high-pass, unity-gain Sallen-Key filter; however, the active component utilized in this invention is a PNP bipolar transistor 132, which produces much less noise than the op amps generally utilized as the active components in Sallen-Key filters. A similar filter, but one that utilizes an NPN transistor active component, was shown in the Electronic Circuit Design Handbook, page 74, FIG. 3, published in 1965 by the editors of EEE magazine and TAB Books, although the formulas provided therein were inadequate for designing this application.

This modified active filter 130, according to this invention, however, requires a very low input impedance to avoid severe detuning that would otherwise result from impedance mismatch. Fortunately, the hybrid source follower buffer circuit 99 already developed for this invention, as described above, has a very low impedance output in the range of about 400Ω. Therefore, the above-described source follower buffer circuit 99 is fortuitously uniquely suited for this modified active filter stage 130, both of which have low noise and low power requirements.

As shown in FIG. 7, a first capacitor 134 and a second capacitor 136 are connected in series to the output 121 of the buffer stage 99. These capacitors 134, 136 are the first and second order energy storage units, respectively, of the filter circuit 130 The base of transistor 132 is connected to capacitor 136, and the transistor 132 is biased by resistors 137, 138, 139. Feedback from the emitter output 133 of the PNP transistor 132 is directed through first order resistor 135 to a pOint between capacitors 134, 136. Resistor 137 behind capacitor 136 is connected to ground 104 and functions as the second order resistor of the filter 130.

The output of this filter 130 is coupled to the output signal wires 124, 126 through the bypass capacitor 116, as in the previously described circuit of FIG. 6. The shunt resistor 119 between the output and ground leads 124, 126 is also provided in this FIG. 7 circuit.

The voltage gain of this filter 130 is very near unity, i.e., within a range of about 95% of actual unity gain. The frequency can be tuned by adjusting either the capacitors 134, 136, or by adjusting the resistors 135, 137. Damping can be adjusted by changing the ratios of resistors 135, 137, while keeping their product constant.

This filter 130, while having the advantages of low power consumption and very low noise, is also simple enough to be miniaturized and placed directly on the printed circuit board 80 along with the buffer circuit 99, so that the entire circuit is contained in the barrel 12 of the hydrophone 10. The result is a highly conditioned, low power, low impedance, but high resolution signal emanated directly from the hydrophone 10 that can be transmitted to remote monitoring and recording equipment (not shown) without the need for further amplification. The filter 130 also provides the capability of being able to tune the hydrophone 10 to various frequencies to match specific environment or geologic basin characteristics, thus optimizing the signal output to specific site conditions. For purposes of description and not for limitation, the circuit of FIG. 7 can be provided with the same piezo monomorph 66, JFET 100 (or clamped input JFET 110), transistor 120, FET 122, bypass capacitor 116, shunt resistors 118, 119, and bias resistor 108, as described above for the FIG. 6 circuit. In addition, the filter transistor 132 can be the same as transistor 120, the resistor 106 can be 5.11KΩ, resistor 138 can be 61.8KΩ, resistor 139 can be 15.4KΩ, the filter capacitors 134, 136 can both be 0.22μf, the resistor 135 can be 14.0KΩ, and the resistor 137 can be 51.1kΩ for 38.8 Hz at 3 db down. Metalized polycarbonate precision capacitors can be used to maintain adequate temperature drift characteristics.

The foregoing description is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention as defined by the claims which follow.

The embodiments of the invention in which an exclusive property or privilege is claimed are defined as follows:

1. Hydrophone apparatus for sensing vibrations in a fluid or fluid-like medium, comprising a carrier plate positioned with a first side in contact with the medium and being subject to vibrational flexure upon being exposed to vibrations in the medium;

vibration sensor means positioned on a second side of said carrier plate, which second side is not in contact with said medium, for sensing the vibrational flexure in the carrier plate and producing electrical signals indicative of the vibrations in the medium;

a chamber adjacent said second side of said carrier plate that is sealed from, and not in fluid communication with, said medium; and, a low impedance Farraday cage surrounding said vibration sensor means.

2. The hydrophone apparatus of claim 1, wherein said low impedance Farraday cage includes said carrier plate, an annular ring that is thicker and larger in diameter than said vibration sensor means and is positioned on said carrier plate around the periphery of said vibration sensor means; and an enclosure plate positioned on the side of said annular ring that is opposite said carrier plate, and wherein said carrier plate, said annular ring, and said enclosure plate are all constructed of conductive materials and are all joined together in electrical contact with each other, thus enclosing said chamber such that said sensor means is positioned in said chamber and completely surrounded by low impedance, conductive materials at a common electrical potential.

3. The hydrophone apparatus of claim 2, including an electrical circuit on a surface-mount printed circuit board for conditioning the electric signals from said vibration sensor means for transmission to signal monitoring and recording equipment, said enclosure plate being a ground plane of said printed circuit board.

4. The hydrophone apparatus of claim 3, wherein said printed circuit board has a top ground plane and a bottom ground plane in spaced-apart relation to each other with a dielectric material sandwiched therebetween, said bottom ground plane being said enclosure plate and the components of electric circuit being surface-mounted on said top ground plane.

5. Hydrophone apparatus for sensing vibrations in a fluid or fluid-like medium, comprising a carrier plate positioned with a first side in contact with the medium and being subject to vibrational flexure upon being exposed to vibrations in the medium;

vibration sensor means positioned on a second side of said carrier plate, which second side is not in contact with said medium, for sensing the vibrational flexure in the carrier plate and producing electrical signals indicative of the vibrations in the medium;

a chamber adjacent said second side of said carrier plate that is sealed from, and not in fluid communication with, said medium;

a buffer circuit having an ultra-high input impedance and a very low output impedance, wherein said buffer circuit is a bipolar transistor assisted, modified source follower, with a first JFET for a first stage direct coupled to a second stage that utilizes a bipolar PNP transistor for lowering the output impedance, such that the reflected resistance through the base of the bipolar transistor is paralleled with the effective output resistance of the first JFET to produce a very low output resistance and a near unity voltage gain, and said bipolar assisted source follower further having constant current source means connected to the source of said first JFET and to the collector of said bipolar transistor for holding the current through the source resistor substantially constant in spite of externally induced spikes and fluctuations on the output signal from the buffer circuit.

6. The hydrophone apparatus of claim 5, wherein said constant current source means includes a self-biased, second JFET with a lower $V_{gs}$ (off) and a lower $I_{dss}$ than said first JFET positioned between the source of said first JFET and the source resistor for said first JFET.

7. The hydrophone apparatus of claim 6, wherein said second JFET is also positioned between the collector of said bipolar transistor and said source resistor.

8. The hydrophone apparatus of claim 5, including a second order, high pass filter circuit connected to the output of said buffer circuit.

9. The hydrophone apparatus of claim 8, wherein said filter circuit includes a capacitor first order element and a capacitor second order element connected in series to the very low impedance output of said buffer circuit and an active PNP bipolar transistor with a feedback from the emitter of said active PNP transistor connected between said first order and second order elements.

10. Hydrophone apparatus, comprising:

a cylindrical body enclosing a first compartment;

vibration sensor means positioned at one end of said first compartment for sensing vibrations in a fluid and producing electrical signals that are indicative of the vibrations in the fluid, wherein said vibration sensor means includes a piezo electric element, one side of which is mounted on a conductive carrier plate, and conductive components substantially surrounding the remaining sides of said piezo electric element in close proximity thereto and in electrical contact with each other and with said carrier plate to form together with said carrier plate a wafer-shaped, low impedance Farraday cage around said piezo electric element;

electric circuit means positioned in said first compartment for conditioning the signals produced by said vibration sensor means for transmission to a remote location;

an elongated boot with flexible sidewalls enclosing a second compartment and attached to said cylindrical body around said vibration sensor means and extending outwardly therefrom such that said vibration sensor means is positioned at one end of said second compartment; and a coupling fluid filling said second compartment.

11. The hydrophone apparatus of claim 10, wherein said wafer-shaped Farraday cage separates and seals said first compartment from said second compartment, with said carrier plate being in contact with said coupler fluid.

12. The hydrophone apparatus of claim 11, wherein said Farraday cage encloses and seals from the outside a chamber in which said piezo electric element is positioned, said chamber being isolated from said coupler fluid.

13. The hydrophone apparatus of claim 12, wherein one of said conductive components surrounding said piezo electric element is a ground plane of a surface-mount printed circuit board and an output lead from the piezo electric element extends out of said Farraday cage only a very short distance to electronic circuit components surface-mounted on said ground plane so that said high impedance lead has only minimal exposure to external EMF interferences outside said Farraday cage.

14. The hydrophone apparatus of claim 13, wherein said electronic circuit components include a low power drawing buffer circuit having a shunted input impedance on the order of about 1 M ohms and a very low output impedance on the order of about 400 ohms and constant current source means for preventing external EMF-induced spikes and interference on the buffer output from causing extraneous buffer-generated signal noises.

15. The hydrophone apparatus of claim 14, including second order, high pass, active filter circuit means connected to the very low impedance output of said buffer circuit for filtering out unwanted noise in the signal, said filter circuit means having capacitive first and second order filter elements and an active, PNP bipolar transistor producing feedback to the second order filter element.

16. In hydrophone apparatus having a high impedance piezo electric element for sensing vibrations in a fluid and producing a signal indicative of the vibrations, the improvement comprising:

a buffer circuit that has ultra-high input impedance on the order of about 1 M ohms and an output impedance on the order of about 400 ohms and constant current source means for preventing external EMF-induced spikes and interference on the output from being transformed into buffer-generated noise, wherein said buffer circuit is a bipolar transistor assisted, modified source follower with a first JFET for a first stage direct coupled to a second stage that has a bipolar PNP transistor for lowering the output impedance, such that the reflected resistance through the base of the bipolar transistor is paralleled with the effective output resistance of the first JFET to produce a very low output resistance and a near unity voltage gain, said constant current source means being connected to the source of said first JFET and to the collector of said bipolar transistor for holding the current through the source resistor substantially constant.

17. The improvement of claim 15, wherein said constant current source means includes a self-biased, second JFET with a lower $V_{gs}$ (off) and a lower $I_{dss}$ than said first JFET positioned between the source of said first JFET and the source resistor for said first JFET.

18. The improvement of claim 17, wherein said second JFET is also positioned between the collector of said bipolar transistor and said source resistor.

19. The improvement of claim 16, including an active high pass filter circuit of at least the second order connected to the output of said buffer circuit.

20. The improvement of claim 19, wherein said filter circuit includes capacitive first and second order elements connected in series to the output of said buffer circuit and an active PNP bipolar transistor with a feedback lead from the emitter of said active PNP transistor connected between said first and second order elements.

21. The improvement of claim 16, wherein said piezo electric element is surrounded in close proximity by a low impedance Farraday cage.

22. The improvement of claim 21, wherein one side of said Farraday cage is a conductive ground plane of a surface-mount printed circuit board with the components of said buffer and filter circuits mounted on the printed circuit board.

23. The improvement or claim 22, wherein there is a small space in said Farraday cage between said ground plane of the printed circuit board and the piezo electric element, and an output lead from the piezo electric element to the printed circuit board extends through said space surrounded by said Farraday cage.

24. The improvement of claim 23, wherein said space in said Farraday cage is sealed from said fluid and said piezo electric element is mounted on one side of a carrier plate and the other side of said carrier plate is in contact with said fluid.

25. The improvement of claim 24, wherein the peripheral sides of said Farraday cage are formed by an annular ring and the circumferential perimeter of said carrier plate is affixed in rigid, immoveable relation to said annular ring.

26. The improvement of claim 25, wherein the circumferential perimeter of said ground plane of said printed circuit board is also affixed and sealed to said carrier plate, said annular ring, and said ground plane form an enclosure around said piezo electric element and around said space between said piezo electric element and said ground plane.

27. The improvement of claim 26, wherein said carrier plate, said annular ring, and said ground plane are all comprised of conductive material and form said low impedance Farraday cage.

* * * * *